United States Patent [19]

Egan

[11] Patent Number: 5,069,951

[45] Date of Patent: Dec. 3, 1991

[54] MAGNETIZED BATH MAT

[76] Inventor: Eugene P. Egan, 4175 Eastwood Dr., Sarasota, Fla. 34232

[21] Appl. No.: 397,981

[22] Filed: Aug. 24, 1989

[51] Int. Cl.[5] ..... B32B 3/00; A47K 3/02

[52] U.S. Cl. ..... 428/172; 428/141; 428/157; 428/167; 428/192; 428/900; 4/581; 4/582; 4/583

[58] Field of Search ..... 428/900, 156, 172, 158, 428/159, 167, 192, 141, 157; 4/574, 581, 583, 582

[56] References Cited

U.S. PATENT DOCUMENTS

| | | | |
|---|---|---|---|
| 3,020,562 | 2/1962 | Reynolds | 4/583 |
| 3,076,976 | 2/1963 | Bogar | 4/583 |
| 3,372,503 | 3/1968 | Weeks | 428/900 |
| 3,515,625 | 6/1970 | Sedlak et al. | 428/900 |
| 3,987,567 | 10/1976 | Fritts | 428/900 |
| 4,242,823 | 1/1981 | Bruno | 40/124 |
| 4,625,344 | 12/1986 | Howard | 4/581 |
| 4,763,945 | 8/1988 | Murry | 296/39.2 |
| 4,931,330 | 6/1990 | Stier et al. | 4/583 |

*Primary Examiner*—Ellis P. Robinson

*Assistant Examiner*—Donald J. Loney

*Attorney, Agent, or Firm*—Charles J. Prescott

[57] ABSTRACT

A magnetized bath mat removably connectable atop the magnetically attractive bottom of a bathtub or shower stall including a thin, flexible magnetic base sheet permanently adhered to and beneath a thin, flexible non-magnetic upper sheet. The base sheet is permanently magnetized so that its bottom surface is releasably attractable to the tub or shower bottom to provide a high degree of slip resistance between the bath mat and the tub or shower bottom during normal use. The upper sheet is coextensive with the base sheet and has a top surface which is generally slip resistant to a user standing or sitting thereatop under wet conditions of use. A very thin intermediate sheet having an opaque coloring similar to that of the upper sheet and permanently adhered between the base and upper sheets may be provided to prevent visual color bleeding of the dark-colored base sheet through to the upper sheet. The base sheet may also be in the form of a perimeter strip extending around at least a portion of the margin of the upper sheet.

4 Claims, 1 Drawing Sheet

Fig. 1
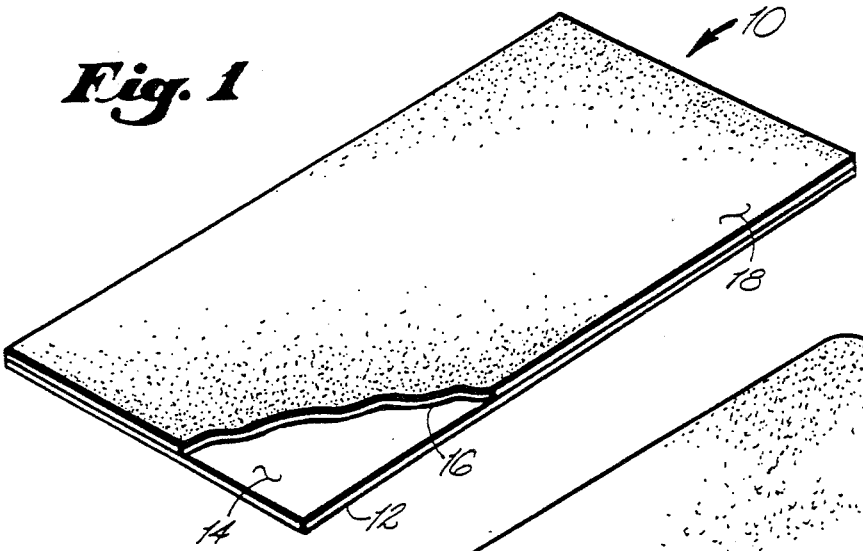
Fig. 2
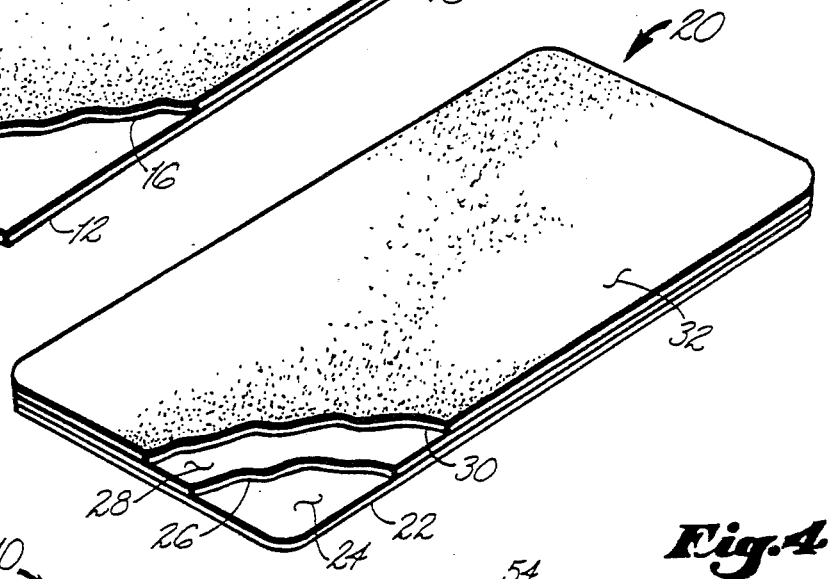
Fig. 3
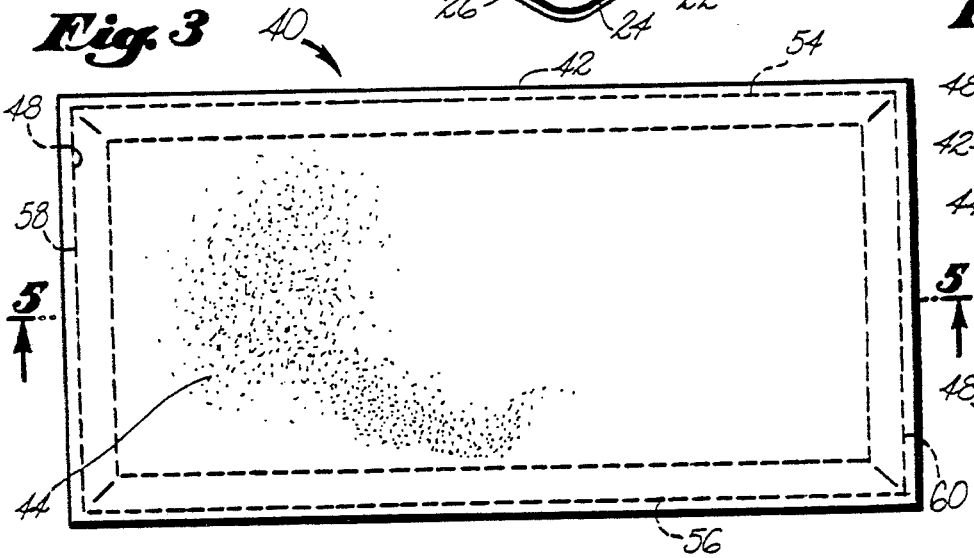
Fig. 4
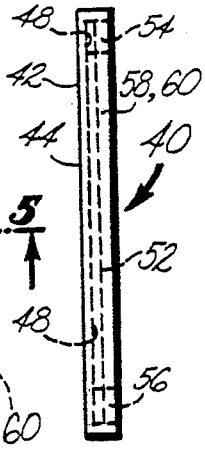
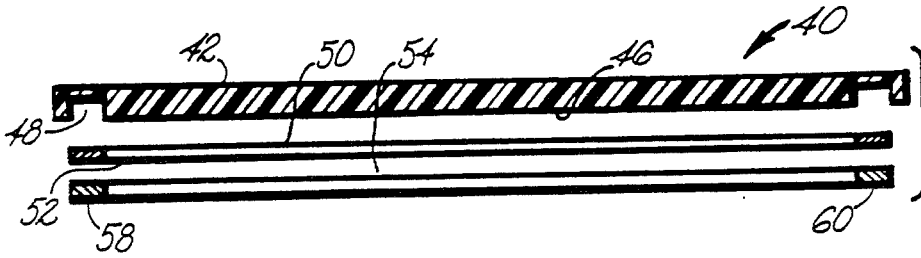
Fig. 5

MAGNETIZED BATH MAT

BACKGROUND OF THE INVENTION

This invention relates generally to slip resistant bathtub and shower stall foot mats, and more particularly to a permanently magnetized bathtub and shower stall mat.

Bathtubs and shower stalls are well known to be quite slippery when wetted and stood or sat upon during showers and baths. One conventional remedy is to adhere strips of adhesive material having abrasive or skid resistant upper surfaces permanently to the bottom of these bathtubs and shower stalls. Another well known remedy for this problem is to utilize rubber or latex bath mats which include an array of suction cups disposed downwardly from the bottom surface which releasably adhere atop the bottoms of bathtubs and shower stalls.

Applicant is also aware of the permanent slip resistant bath mat invented by T. J. Howard as disclosed in U.S. Pat. No. 4,625,344. However, this invention is somewhat different than that of the present invention and is intended to be permanently adhered to the bathtub or shower stall bottom.

Both permanently adhered bath mats and suction cup-adhered mats result in long-term damage to the porcelain surfaces of tubs and shower stalls.

Although non-magnetic fiberglass and plastic materials are becoming more widely utilized, nonetheless many existing and currently manufactured bathtubs and shower stalls are fabricated of magnetically attractive material having an overlay of porcelain, ceramic, or plastic coloring or the like. It is these types of bathtubs and shower stalls with which the present invention is intended for use.

The present invention provides a permanently magnetized bath mat which is removably connectable atop these well known bathtub and shower stalls which include a magnetically attractive metal material serving as the basic structural component thereof. The present invention is thus intended to be utilized with such magnetically attractive bathtub and shower stalls to afford slip resistance during use under wet conditions and is releasably attachable atop their bottoms for easy removal during cleaning.

BRIEF SUMMARY OF THE INVENTION

This invention is directed to a magnetized bath mat removably connectable atop the magnetically attractive bottom of a bathtub or shower stall and includes a thin, flexible magnetic base sheet permanently adhered to and beneath a thin, flexible non-magnetic upper sheet. The base sheet is permanently magnetized so that its bottom surface is releasably attractable to the tub or shower bottom to provide a high degree of slip resistance between the bath mat and the tub or shower bottom during normal use. The upper sheet is coextensive with the base sheet and has a top surface which is generally slip resistant to a user standing or sitting thereatop under wet conditions of use. A very thin intermediate sheet having an opaque coloring similar to that of the upper sheet and permanently adhered between the base and upper sheets may be provided to prevent visual color bleeding of the normally dark-colored base sheet through to the upper sheet. The base sheet may also be in the form of a perimeter strip extending around at least a portion of the margin of the upper sheet.

It is therefore an object of this invention to provide a slip resistant, magnetized bath mat which is removably connectable atop the bottom surface of bathtubs and shower stalls which are fabricated of magnetically attractive structural materials.

It is another object of this invention to provide an easily removable, slip resistant, magnetized bath mat for non-damaging or non-abrasive use in conjunction with these types of bathtubs and shower stalls.

In accordance with these and other objects which will become apparent hereinafter, the instant invention will now be described with reference to the accompanying drawings.

BRIEF DESCRIPTION OF THE DRAWINGS

FIG. 1 is a perspective broken view of one embodiment of the invention.

FIG. 2 is a perspective broken view of the preferred embodiment of the invention.

FIG. 3 is a top plan view of yet another embodiment of the invention.

FIG. 4 is a right end elevation view of FIG. 3.

FIG. 5 is an exploded section view in the direction of arrows 5—5 in FIG. 3.

DETAILED DESCRIPTION OF THE INVENTION

Referring now to the drawings, and particularly to FIG. 1, the preferred embodiment of the invention is shown generally at numeral 10 and includes a thin, flexible base sheet 12 having a layer of adhesive 14 over its top surface which serves to permanently adhere upper layer 16, which is generally coextensive with base sheet 12, thereto. Alternately, upper sheet 16 may be provided with the layer of adhesive 14 applied to its bottom surface to perform the same permanent adhesion between the upper and base sheets 16 and 12.

Upper sheet 16, formed of very thin, flexible vinyl material, also includes a textured surface 18 which is intended to provide a high degree of slip resistance for the user who is standing or sitting thereatop under wet conditions as during bathing or showering.

Both base and upper sheets 12 and 16 are fabricated of thin, flexible, generally non-porous and homogeneous sheet material. The upper sheet 16 is fabricated of non-magnetic material such as a very thin sheet of vinyl fabric having a molded, textured top surface as supplied by 3-M Company under their trademark SAFETY-WALK, a fine grade, textured resilient anti-slip polymer. The preferred thickness of upper sheet 16 is 0.02". The base sheet 12 is permanently magnetized and has generally smooth top and bottom surfaces. The base sheet 12 is fabricated of a plasticized, flexible material, preferably 0.025" in thickness, which is impregnated uniformly with permanently magnetized particles in a magnetic strength sufficient to releasably adhere to the magnetically attractive bottom of showers and bathtubs. The base member 12 thus provides a high degree of slip resistance between the base member 12 and the tub or shower bottom during normal use.

The commercially available product for use in fabricating the base sheet 12 is manufactured by B. F. Goodrich Corporation under the trademark KOROSEAL. This product is a thin, flexible magnetic sheeting provided in both roll sheet and strip form which may be permanently magnetized in a number of variations. In its natural state, KOROSEAL is brown. However, it may be painted in any commercial enamel or lacquer or laminated with a very thin sheet of vinyl over its exposed (top) surface.

Turning to the embodiment 20 shown in FIG. 2, applicant has utilized this optional feature of the KOROSEAL by including an intermediate sheet 26 of very thin, flexible vinyl material having an opaque color which is generally similar to that of the upper sheet 30 having non-skid texturing 32 as previously described. This intermediate sheet 26 is permanently adhered during manufacture to the base sheet 22 by a layer of adhesive 24. A second layer of adhesive 28 permanently bonds upper sheet 30 to intermediate sheet 26. This intermediate sheet 26, having the opaque coloring similar to that of the upper sheet 30, prevents visual bleeding of the natural brown coloring of the magnetized base sheet 22 of KOROSEAL through to the upper sheet 30. Because the entire embodiment 20, as well as the embodiment 10 previously described, is quite thin and flexible, the intermediate sheet 26 is preferred to eliminate this visual bleeding problem.

Referring now to FIGS. 3, 4 and 5, another embodiment of the invention is shown generally at numeral 40 and includes an upper sheet 42 formed of thin vinyl or latex material having texturing 44 formed into its top surface to enhance slip resistance under wet conditions as previously described.

This embodiment 40 also includes perimeter strips of magnetized KOROSEAL material 54, 56, 58, and 60. These permanently magnetized strips 54, 56, 58, and 60 extend along and adjacent the perimeter of upper sheet 42 and are permanently adhered into a mating cavity or recess 48 which also extends around and adjacent to the entire perimeter of rectangular upper sheet 42.

Each of these permanently magnetized flexible strips of KOROSEAL 54, 56, 58, and 60 are permanently bonded or adhered within cavity 48 having a very thin intermediate vinyl layer 52 adhered to the top surface of these magnetized strips 54 56, 58, and 60 to prevent visual bleeding of the brown coloring of the KOROSEAL as previously described. The entire arrangement is structured so that the bottom surface of upper sheet 42 and the bottom surfaces of magnetized strips 54, 56, 58, and 60 are generally co-planer so as to provide a continuous uninterrupted smooth bottom surface of the bath mat 40.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A slip resistant magnetized bath mat removably connectable atop the magnetically attracted bottom of a bathtub or shower stall, said bath mat comprising:

a thin, non-porous, homogeneous, flexible magnetic base sheet having generally smooth top and bottom surfaces and permanently magnetized so that said base sheet bottom surface is releasably attractable to the tub or shower bottom only by said base sheet to provide a high degree of slip resistance between said bath mat and the tub or shower bottom during normal use;

a thin, non-porous, flexible, non-magnetic, homogeneous, upper sheet having a generally smooth bottom surface permanently adhered atop and generally coextensive with said base sheet;

said upper sheet having a textured top surface which is generally slip resistant to a user standing or sitting there atop under wet conditions;

a very thin, non-porous, homogeneous, flexible intermediate sheet having an opaque coloring generally shaded similar to that of said upper sheet and permanently adhered between, and generally coextensive with, said upper and base sheets;

said intermediate preventing visual bleeding of the color of said base sheet through to said upper sheet.

2. A slip resistant magnetized bath mat removably connectable atop the magnetically attracted bottom of a bathtub or shower stall, said bath mat comprising:

a thin, non-porous, flexible, homogeneous, non-magnetic upper sheet having a generally smooth bottom surface and a textured top surface which is generally slip resistant to a user standing or sitting there atop under wet conditions;

a thin, porous, homogeneous, permanently magnetic base perimeter strip having an upper surface permanently adhered, and extending along at least a portion of the perimeter of said upper sheet and having a generally smooth bottom surface;

said base strip permanently magnetized so that said base strip bottom surface is releasably attractable to the tub or shower bottom only by said base strip to provide a high degree of slip resistance between said bath mat and the tub or shower bottom during normal use;

a very thin, non-porous, homogeneous, flexible intermediate sheet having an opaque coloring generally shaded similar to that of said upper sheet and permanently adhered between, and generally coextensive with, said upper and base sheets;

said intermediate preventing visual bleeding of the color of said base sheet through to said upper sheet.

3. A slip resistant magnetized bath mat as set forth in claim 2, wherein:

said base perimeter strip is recessed into a groove formed into said upper sheet bottom surface whereby said base perimeter strip bottom surface and said upper sheet bottom surface are continuous and uninterrupted.

4. A slip resistant magnetized bath mat as set forth in claim 3, wherein:

said base perimeter strip extends along the entire perimeter of said upper sheet.

* * * * *